US011459843B2

(12) United States Patent
Bartlett et al.

(10) Patent No.: US 11,459,843 B2
(45) Date of Patent: Oct. 4, 2022

(54) TUBING HANGER SPACE-OUT MECHANISM

(71) Applicant: Dril-Quip, Inc., Houston, TX (US)

(72) Inventors: Chris D. Bartlett, Houston, TX (US); David Scantlebury, Houston, TX (US); Rick Murphy, Houston, TX (US); Andrew Mitchell, Houston, TX (US); Fife B. Ellis, Houston, TX (US); Gregory Norwood, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 4 days.

(21) Appl. No.: 17/118,100

(22) Filed: Dec. 10, 2020

(65) Prior Publication Data

US 2021/0180425 A1 Jun. 17, 2021

Related U.S. Application Data

(60) Provisional application No. 62/947,506, filed on Dec. 12, 2019.

(51) Int. Cl.
*E21B 33/04* (2006.01)
*E21B 41/00* (2006.01)

(52) U.S. Cl.
CPC ..... *E21B 33/04* (2013.01); *E21B 41/0021* (2013.01); *E21B 2200/01* (2020.05)

(58) Field of Classification Search
CPC .... E21B 17/046; E21B 33/04; E21B 33/0415; E21B 33/043
See application file for complete search history.

(56) References Cited

U.S. PATENT DOCUMENTS 4,067,385 A 1/1978 Schwager et al.
4,770,248 A 9/1988 Houlgrave et al.
5,076,356 A * 12/1991 Reimert ..... E21B 33/043 166/182
5,503,230 A 4/1996 Osborne et al.
(Continued)

FOREIGN PATENT DOCUMENTS

GB 2200154 A * 7/1988 ..... E21B 33/04
GB 2233364 A * 1/1991 ..... E21B 33/03
(Continued)

OTHER PUBLICATIONS

Search Report issued in related United Kingdom Patent Application No. GB2019380.1 dated May 27, 2021, 1 page.

*Primary Examiner* — Jennifer H Gay
(74) *Attorney, Agent, or Firm* — Baker Botts L.L.P.

(57) ABSTRACT

A space-out mechanism that may be used in a tubing hanger system to install a tubing hanger and rigidize the tubing hanger and a casing hanger within a wellhead housing in a single trip is provided. The space-out mechanism may include two pieces that are configured to rotate against each other such that the axial length of the space-out mechanism can be adjusted to remove any axial gaps created in the installation of the tubing hanger or rigidizing of the tubing hanger and casing hanger within the wellhead housing. The two pieces of the space-out mechanism may include a ramp ring and a piston. The ramp ring and piston may each have ramp surfaces that rotate and bear against each other until the system is rigidized.

20 Claims, 12 Drawing Sheets

(56) References Cited

U.S. PATENT DOCUMENTS

| | | | | |
|---|---|---|---|---|
| 8,387,708 | B2 * | 3/2013 | Anderson | E21B 33/04 166/217 |
| 10,066,456 | B2 * | 9/2018 | Berryhill | E21B 33/038 |
| 10,100,595 | B2 * | 10/2018 | Nguyen | E21B 33/04 |
| 10,287,839 | B2 * | 5/2019 | Lugtmeier | E21B 33/04 |
| 11,072,984 | B2 * | 7/2021 | Queiroz | E21B 33/0415 |
| 2009/0211761 | A1 | 8/2009 | Broussard | |
| 2010/0078176 | A1 | 4/2010 | Christie | |
| 2010/0101800 | A1 | 4/2010 | June et al. | |
| 2012/0043094 | A1 * | 2/2012 | Anderson | E21B 33/04 166/382 |
| 2013/0126181 | A1 | 5/2013 | Bell | |
| 2015/0041151 | A1 * | 2/2015 | Cocker, III | E21B 33/0415 166/380 |
| 2016/0186523 | A1 | 6/2016 | Nguyen | |
| 2016/0265298 | A1 * | 9/2016 | Nguyen | E21B 43/121 |
| 2016/0326824 | A1 * | 11/2016 | Lugtmeier | E21B 33/0415 |
| 2017/0058622 | A1 * | 3/2017 | Nguyen | E21B 43/10 |
| 2017/0152721 | A1 * | 6/2017 | Bories | E21B 33/04 |
| 2017/0167218 | A1 * | 6/2017 | Cheah | E21B 23/02 |
| 2017/0198540 | A1 * | 7/2017 | Chirko | E21B 33/04 |
| 2017/0254166 | A1 * | 9/2017 | Berryhill | E21B 33/038 |
| 2018/0163491 | A1 * | 6/2018 | Nguyen | E21B 33/04 |
| 2018/0258726 | A1 * | 9/2018 | Levert, Jr. | E21B 23/02 |
| 2021/0010340 | A1 * | 1/2021 | Queiroz | E21B 33/043 |
| 2021/0087899 | A1 * | 3/2021 | DeBerry | E21B 17/023 |
| 2021/0317718 | A1 * | 10/2021 | Mora | E21B 33/03 |

FOREIGN PATENT DOCUMENTS

| | | | | |
|---|---|---|---|---|
| GB | 2256664 | A * | 12/1992 | E21B 33/04 |
| GB | 2262298 | A * | 6/1993 | E21B 33/043 |
| GB | 2397312 | A | 7/2004 | |
| WO | WO-2009014795 | A2 * | 1/2009 | E21B 23/00 |
| WO | 2018/226239 | A1 | 12/2018 | |
| WO | 2019/093997 | A1 | 5/2019 | |
| WO | 2019/209298 | A1 | 10/2019 | |
| WO | WO-2020204729 | A1 * | 10/2020 | E21B 17/02 |

* cited by examiner

TUBING HANGER SPACE-OUT MECHANISM

TECHNICAL FIELD

The present disclosure relates generally to wellhead systems and, more particularly, to tubing hanger space-out mechanisms used to secure a tubing hanger in a wellhead in one trip.

BACKGROUND

Conventional wellhead systems include a wellhead housing and a subsurface casing string extending from the wellhead into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. Successive casing hangers carrying casing strings of decreasing diameter are installed through the wellbore, and then, a tubing string is installed through the well bore. A tubing hanger connectable to the upper end of the tubing string is supported within the wellhead housing above the last casing hanger, which carries the smallest diameter casing string, for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

For various reasons, a tubing hanger or casing hanger within the wellhead may move axially upward, particularly when the wellhead is part of a production system where downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus. Further, for various reasons, the casing hanger may stack higher than intended. Thus, it must be ensured that the tubing hanger is properly sized to lock to the wellhead and that the casing hanger is prevented from moving axially in response to such axial forces.

Various tubing hanger designs and methods have been conceived of for ensuring the tubing hanger is locked to the wellhead housing and the tubing hanger system and casing hanger are rigidized (locked axially) within the wellhead housing. A tubing hanger, once run in and locked into the wellhead, is intended to prevent axial movement of the uppermost casing hanger and seal assembly with respect to the wellhead. Typically, a tubing hanger is run into the wellhead, landed on the casing hanger, and locked to a locking profile on an inner wall of the wellhead housing, which also acts to secure the casing hanger within the wellhead. To install existing tubing hangers, it is first necessary to run a lead impression tool into the wellhead to measure the distance between the top of the casing hanger and the housing locking profile. The lead impression tool is a small block of soft metal, usually lead, which is lowered into the wellhead to take an impression to determine the internal profile of the wellhead, which after being retrieved can be measured to determine the distance between the top of the casing hanger and the housing locking profile. With this information, the tubing hanger can be adjusted at the surface so that once the tubing hanger is run in and secured to the wellhead, it provides a zero-gap connection between the tubing hanger, the casing hanger, and the wellhead housing and creates any desired pre-load.

This process of taking measurements in the wellhead via a lead impression tool, retrieving the tool to the surface, and then adjusting and installing a tubing hanger into the wellhead is a time-consuming installation process requiring multiple trips into the wellhead. It is now recognized that a need exists for a tubing hanger system that allows for a single-trip installation process.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1A:
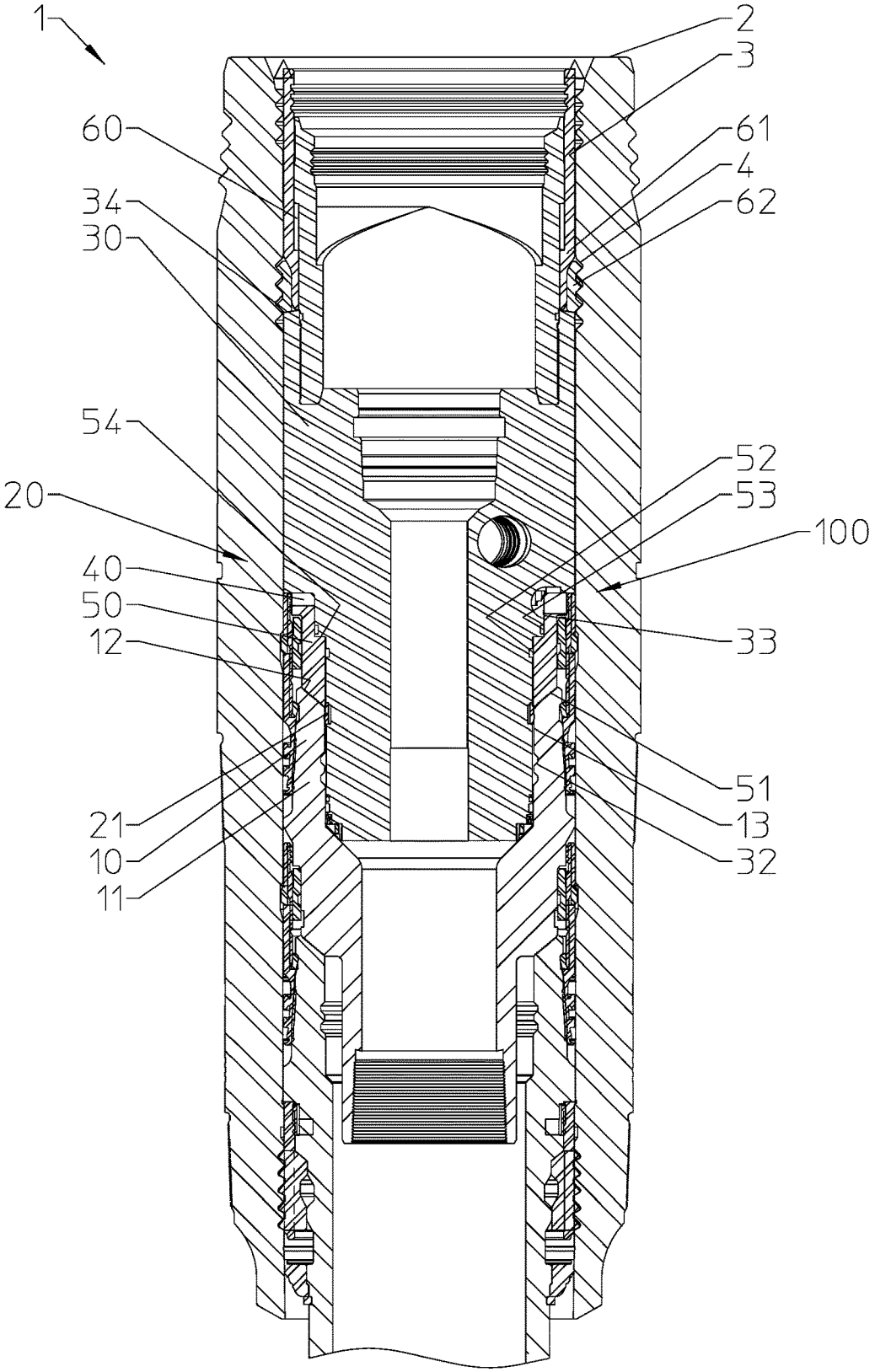
FIG. 1A is a partial cutaway view of a wellhead system having a tubing hanger system, in accordance with an embodiment of the present disclosure.
Figure 1B:
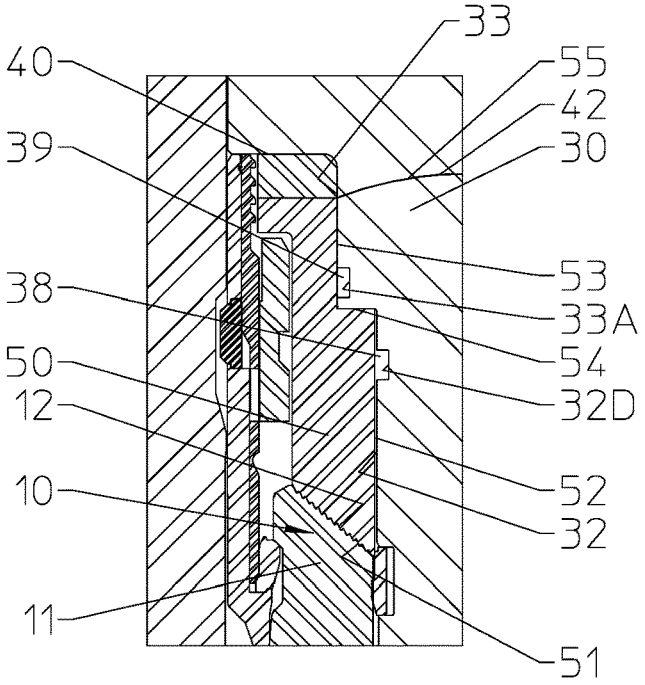
FIG. 1B is a close-up of the partial cutaway view of the wellhead system having the tubing hanger system of FIG. 1A, in accordance with an embodiment of the present disclosure.
Figure 1C:
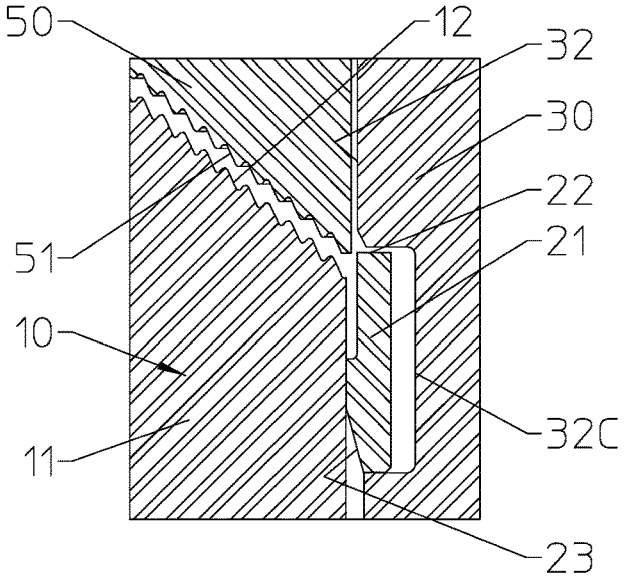
FIG. 1C is a close-up of the partial cutaway view of the wellhead system having the tubing hanger system of FIG. 1A, in accordance with an embodiment of the present disclosure.
Figure 2:
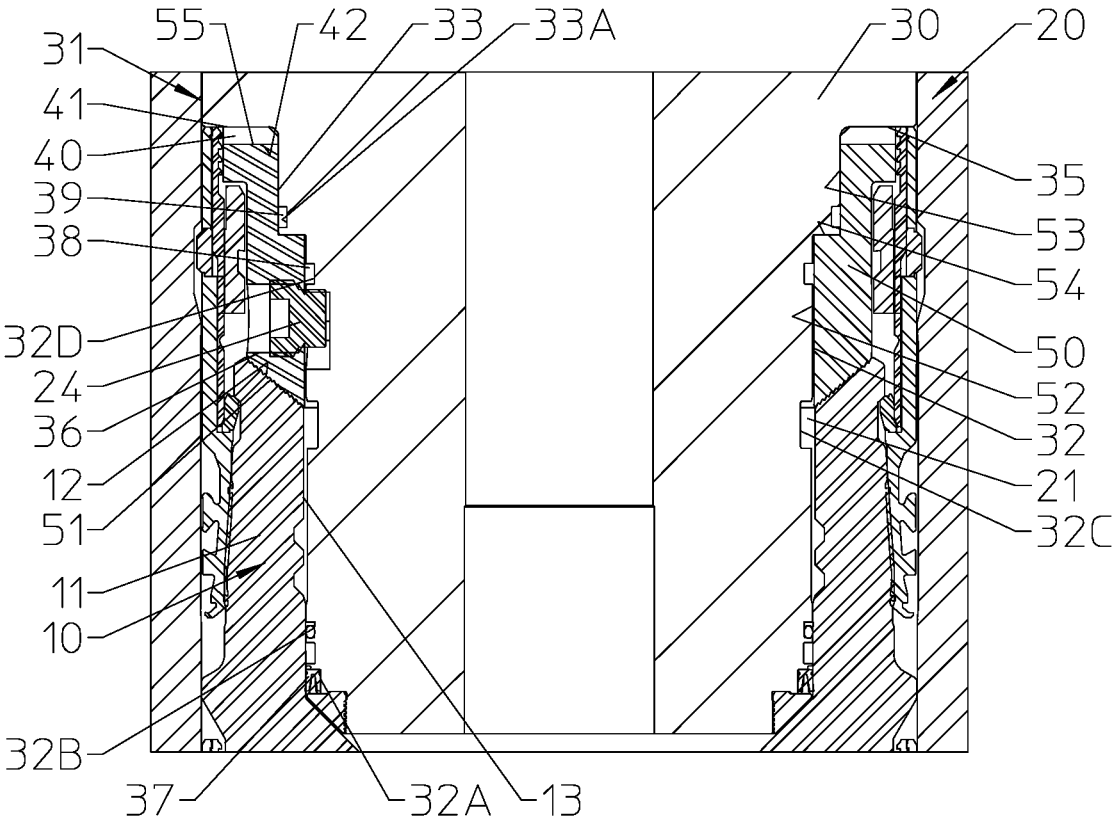
FIG. 2 is a partial cutaway view of the tubing hanger system of FIG. 1A, in accordance with an embodiment of the present disclosure.
Figure 3A:
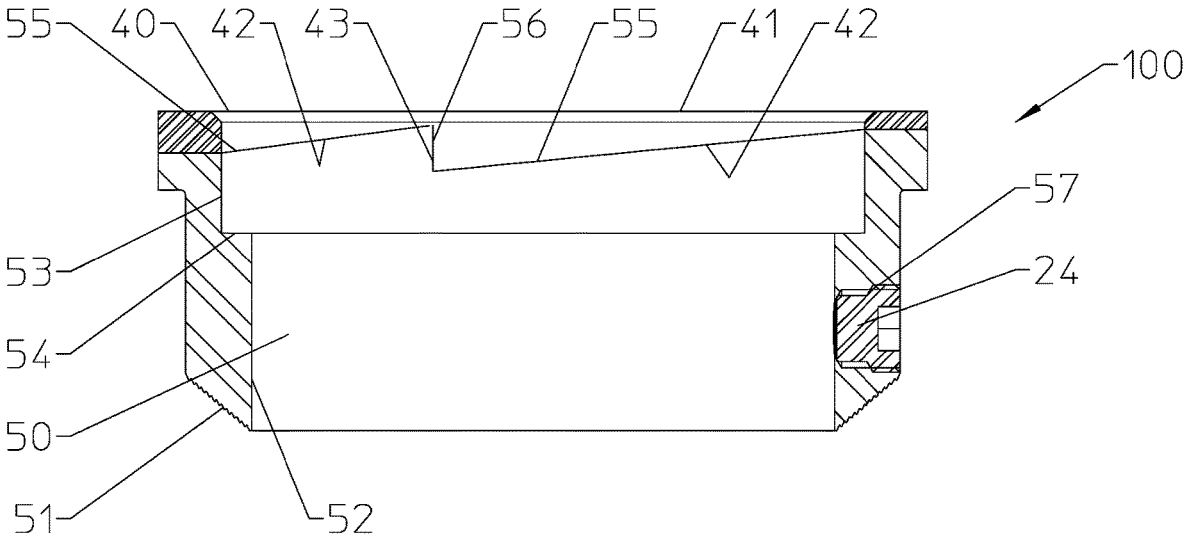
FIG. 3A is a cutaway view of a ramp ring and a piston of the tubing hanger system of FIG. 1A where the ramp ring is disposed in an initial position, in accordance with an embodiment of the present disclosure.
Figure 3B:
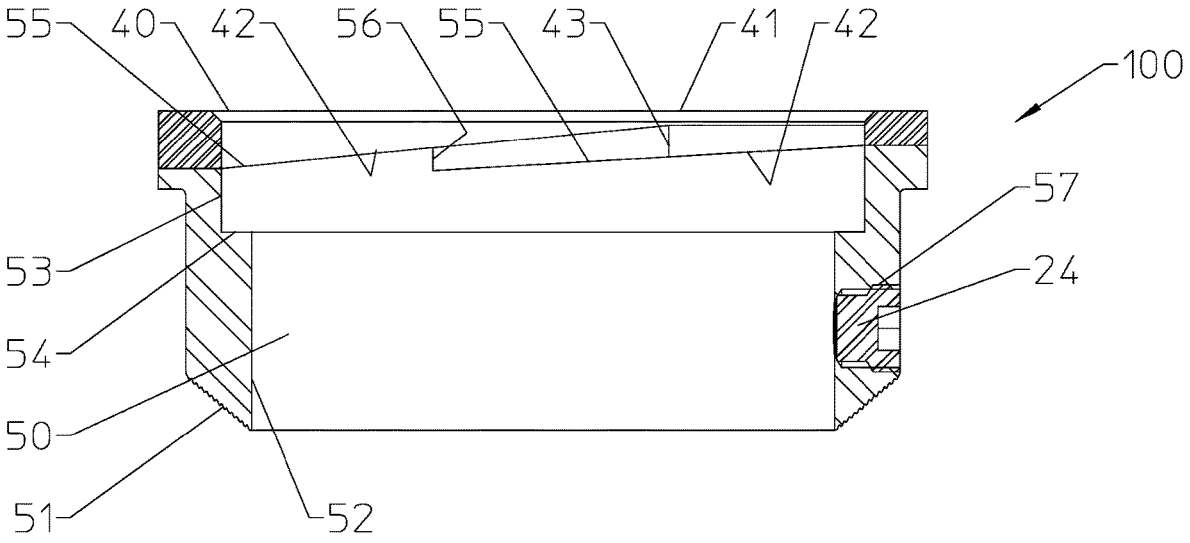
FIG. 3B is a cutaway view of a ramp ring and a piston of the tubing hanger system of FIG. 1A where the ramp ring is disposed in a rotated position, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a tubing hanger system that may be installed within a wellhead system in a single trip. The tubing hanger system may include multiple pieces that are coupled together such that the tubing hanger may be locked to an inner wall of a high-pressure wellhead housing while applying a preload on a casing hanger, thereby rigidizing the tubing hanger system and casing hanger within the wellhead housing. The tubing hanger system may be run into the wellhead system until the tubing hanger system abuts the casing hanger. Then, the tubing hanger system may be picked up until the tubing hanger system is locked against an inner wall of the high-pressure housing. Lastly, a space-out mechanism of the tubing hanger system may actuate such that it takes up any gaps formed axially by being picked up, thus rigidizing the tubing hanger system and casing hanger within the wellhead housing. The installation process for the tubing hanger system may be accomplished entirely during a single trip into the wellhead as opposed to a first trip with a lead impression tool followed by an adjustment of the tubing hanger system at the surface and a subsequent trip downhole to install the adjusted tubing hanger system. The disclosed systems and method provide both time savings (since only one trip into the wellhead is necessary) and cost savings (since an additional lead impression tool is not required) compared to existing tubing hanger installation techniques.

Referring now to FIGS. 1A-3B, certain components of a wellhead system 1 are illustrated according to one or more embodiments of the present disclosure. The illustrated wellhead system 1 may be a subsea wellhead assembly. However, similar techniques may be used in land-based wellhead systems as well. The wellhead system 1 may include a wellhead housing 2, a casing hanger 10, a tubing hanger system 20, and a locking mechanism 60. The casing hanger 10 may be landed within the wellhead housing 2. The tubing hanger system 20 may then be landed upon the casing hanger 10 within the wellhead housing 2. Lastly, the locking mechanism 60 may be landed upon the tubing hanger system 20 within the wellhead housing 2. The wellhead housing 2 may include a central bore 3 having locking profile 4 disposed thereon. The locking mechanism 60 may engage the locking profile 4 of the wellhead housing 2 in order to lock the casing hanger 10, the tubing hanger system 20, and the locking mechanism 60 in place within the wellhead housing 2 and rigidize the system.

The casing hanger 10 may include a casing hanger body 11 having an upper load shoulder 12 and a radially interior profile 13. The upper load shoulder 12 may be tapered inwards towards the interior profile 13 and ridges may be formed along the upper load shoulder 12. However, one of ordinary skill in the art would understand that in other embodiments, the upper load shoulder may be tapered outwards away from the interior profile or may not be tapered at all. Additionally, one of ordinary skill in the art would understand that in other embodiments, the upper load shoulder may be smooth or curved instead of having ridges.

The tubing hanger system 20 may include a tubing hanger body 30 and a space-out mechanism 100. In one or more embodiments, the space-out mechanism may include a ramp ring 40 and a piston 50. However, one of ordinary skill would understand that space-out mechanisms of other embodiments may include a plurality of ramp rings or wedges. The tubing hanger body 30, the ramp ring 40, and the piston 50 may be assembled together before being inserted into the wellhead housing 2 such that the tubing hanger system 20 may be installed in a single trip. The manner in which each of the parts in the tubing hanger system 20 are coupled will be discussed further below. Additionally, the tubing hanger system 20 may be run into the wellhead housing 2 and disposed such that the tubing hanger body 30 seals against the interior profile 13 of the casing hanger body 11 and the piston 50 abuts the upper load shoulder 12 of the casing hanger 10. In one or more embodiments, to ensure that tubing hanger system 20 is properly seated on the casing hanger 10, one or more safety lock mechanisms may be used. The safety lock mechanisms according to one or more embodiments of the present disclosure will be discussed further below.

Still referring to FIGS. 1A-3B, the tubing hanger body 30, according to one or more embodiments of the present disclosure, may include a radially exterior profile 31 defined, in part, by a first sealing profile 32, a second sealing profile 33, an upward facing contact surface 34, a downward facing contact surface 35, and an axially extending pin slot 36. The first sealing profile 32 may include a first seal groove 32*a* in which a tubing hanger to casing hanger seal 37 is disposed, a second seal groove 32*b* in which an o-ring may be disposed, a third groove 32*c* in which a retainer ring 21 may be disposed, and a fourth seal groove 32*d* in which a first tubing hanger to piston seal 38 may be disposed. The second sealing profile 33 may include groove 33*a* in which a second tubing hanger to piston seal 39 may be disposed.

Further, the ramp ring 40 of the space-out mechanism 100, according to one or more embodiments of the present disclosure, may include an upper contact surface 41, ramp surfaces 42, and rotational stop surfaces 43. The ramp ring 40 may be disposed adjacent to the tubing hanger body 30 such that the ramp ring 40 is positioned about the second sealing surface 33 of the tubing hanger body 30 and, at least when the tubing hanger system 20 is run-in and when the tubing hanger system 20 is in a fully locked position, the upper contact surface 41 may contact the downward facing contact surface 35 of the tubing hanger body 30. Additionally, in one or more embodiments, a bottom of the ramp ring 40 may have a plurality of ramp surfaces 42 and a plurality of rotational stop surfaces 43. By way of example, in one or more embodiments, the ramp ring 40 may include three ramp surfaces each extending 120° circumferentially about the ramp ring 40. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 42 may have a constant 3.5° taper. However, one of ordinary skill in the art will understand that in other embodiments the ramp surface may include steps or ridges and/or may have a constant or changing taper in the range of 0.5°-7°. Alternatively, the ramp surface may include any range of angles, surface geometries, and/or coatings that prevent rotation once installed.

Additionally, the piston 50 of the space-out mechanism 100 may include a lower load shoulder 51, a first interior seal surface 52, a second interior seal surface 53, an interior shoulder 54, ramp surfaces 55, rotational stop surfaces 56, and a threaded pin borehole 57. The piston 50 may be disposed adjacent to the casing hanger 10, the tubing hanger body 30, and the ramp ring 40 such that piston is positioned about the first sealing surface 32 and the second sealing surface 33 of the tubing hanger body 30. Further, the piston 50 may abut the casing hanger 20 on one side and the ramp ring 40 on the other side. Thus, in one or more embodiments, the lower load shoulder 51 may abut the upper load shoulder 12 of the casing hanger 10. As such, the lower load shoulder 51 may be tapered to match the taper of the upper load shoulder 12 of the casing hanger 10 and ridges may be formed along the lower load shoulder 51 to match the ridges of the upper load shoulder 12 of the casing hanger 10. However, as discussed above with regard to the upper load shoulder 12 of the casing hanger 10, one of ordinary skill in the art would understand that in other embodiments, the lower load shoulder may be tapered in a number of ways as long as the taper of the lower load shoulder matches the taper of the upper load shoulder. Additionally, one of ordinary skill in the art would understand that in other embodiments, the upper load shoulder may be smooth or curved instead of having ridges.

Further, the first interior seal surface 52 and second interior seal surface 53 of the piston 50 may be disposed such that when the tubing hanger system 20 is fully assembled, the first tubing hanger to piston seal 38 and the second tubing hanger to piston seal 39 may seal against the first interior seal surface 52 and the second interior seal surface 53 of the piston 50, respectively. Furthermore, when the tubing hanger system 20 is disposed within the wellhead housing 2 and landed on the casing hanger 10, the first sealing profile 32 of the tubing hanger body 30 may sit within the casing hanger 10 such that the tubing hanger to casing hanger seal 37 seals against the interior profile 13 of the casing hanger 10. This sealing profile created between the casing hanger 10, the tubing hanger body 30, and the piston 50 may create a piston force that acts in a downward direction against the interior shoulder 54 of the piston 50, which may hold the piston 50 in abutment with the casing hanger 10 in the event that the tubing hanger body 30 is shifted in an upward direction. Additionally, in one or more embodiments, the threaded pin borehole 57 of the piston 50 may be aligned with the pin slot 36 of the tubing hanger body 30, and an anti-rotation pin 24 may be coupled to the threaded pin borehole 57 such that the anti-rotation pin 24 rests within the pin slot 36. This anti-rotation pin, according to one or more embodiments of the present disclosure, may rotationally couple the piston to the tubing hanger body 30 such that the ramp ring 40 may rotate relative to the piston 50 while allowing the tubing hanger body 30 to move axially relative to the piston 50 so that any gap that is formed in locking the tubing hanger system 20 and casing hanger 10 to the wellhead housing 2 may be filled. However, one of ordinary skill in the art would understand that in other embodiments a variety of methods may be used to rotationally secure the piston and the tubing hanger body such that the ramp ring may rotate relative to the tubing hanger body without also rotating the piston.

Furthermore, still referring to FIGS. 1A-3B, the ramp surfaces 55 of the piston 50 may be configured to abut the ramp surfaces 42 of the ramp ring 40 at least when the tubing hanger system 20 is run-in and when the tubing hanger system 20 is in a fully locked position. As discussed above with regard to the ramp surfaces 42 of the ramp ring 40, the ramp surfaces 55 of the piston 50 may be designed in various ways so long as the ramp surfaces 55 match the ramp surfaces 42. By way of example, in one or more embodiments, the piston may include three ramp surfaces each extending 120° circumferentially about the piston 50. However, one of ordinary skill in the art will understand that in other embodiments, the piston may have a single ramp surface and a single rotational stop surface or any combination of equal numbers of ramp surfaces and rotational stop surfaces that match the number of ramp surfaces and rotational stop surfaces of the ramp ring. Further, in one or more embodiments of the present disclosure, the ramp surfaces 55 may have a constant 3.5° taper. However, one of ordinary skill in the art will understand that in other embodiments the ramp surface may include steps or ridges and/or may have a constant or changing taper in the range of 0.5°-7°. One of ordinary skill will appreciate that the ramp surfaces are designed such that the contact between the ramp surfaces is self-locking and compressive forces between the surfaces will not cause the piston and ramp ring to rotate relative to each other once the tubing hanger system is in the fully locked position. Further, the rotational stop surfaces 56 of the piston 50 and the rotational stop surfaces 43 of the ramp ring 40 may be configured to abut each other at least when the tubing hanger system 20 is run in and may prevent the piston and ramp ring from rotating relative to each other in one direction.

Additionally, the locking mechanism 60, according to one or more embodiments of the present disclosure, may include a locking mandrel 61 and locking dogs 62. The plurality of locking dogs 62 may be supported around the locking mandrel 61. The locking mechanism 60 may be run into the wellhead housing 2 until the locking mechanism 60 abuts the upward facing contact surface 34 of the tubing hanger body 30. In one or more embodiments, a bottom surface of the locking dogs 62 may directly abut the upward facing contact surface 34 and may be pushed outward into the locking profile 4 of the wellhead housing 2 by a compressive force caused by the locking mandrel 61 pushing down on the locking dogs 62. The locking dogs 62 may have ridges disposed on an outer surface that match the locking profile 4 disposed along the central bore 3 of the wellhead housing 2.

Further, the tubing hanger system 20 may include one or more safety locks to ensure that the system is properly run into the wellhead housing 2 and features of the system are not activated prematurely. By way of example, in one or more embodiments, a retainer ring 21 may be included in the tubing hanger system 20 so as to make sure that the piston 50 is properly seated upon the casing hanger 10 and the seals of the tubing hanger body 30 are set within the piston 50 and the casing hanger 10 as necessary for the system to function properly. The retainer ring 21 may be a split ring disposed within the third groove 32*c* of the tubing hanger body 30 and may have an uncollapsed outer diameter that is greater than both the diameter of the interior profile 13 of the casing housing 10 and the first interior seal surface 52 of the piston 50. Further, in a pre-run-in assembled state, the third groove 32*c* and the retainer ring 21 may be disposed below the lower load shoulder 51 of the piston 50. This disposition of the retainer ring 21 and third groove 32*c* may be such that the lower load shoulder 51 of the piston 50 cannot abut the upper load shoulder 12 of the casing hanger 10 until the retainer ring 21 is collapsed into the third groove 32*c*. The retainer ring 21 may include an upper contact surface 22 and a lower contact surface 23. The lower contact surface 23 may be tapered such that downward forces from the piston 50 and/or tubing hanger body 30 during run-in push the tapered lower contact surface 23 into an interior edge of the upper load shoulder 12 of the casing hanger 10 and cause the retainer ring 21 to collapse into the third groove 32*c*. Once collapsed, the outer diameter of the retainer ring 21 may be smaller than the interior profile 13 of the casing hanger 10, allowing the tubing hanger system 20 to properly seat within and against the casing hanger 10. Thus, in one or more embodiments, the retainer ring 21 needs to be collapsed in order for the lower load shoulder 51 of the piston 50 to be able to abut the upper load shoulder 12 of the casing hanger 10. Additionally, various other safety locks may be used in one or more embodiments of the present disclosure.

Figure 4:
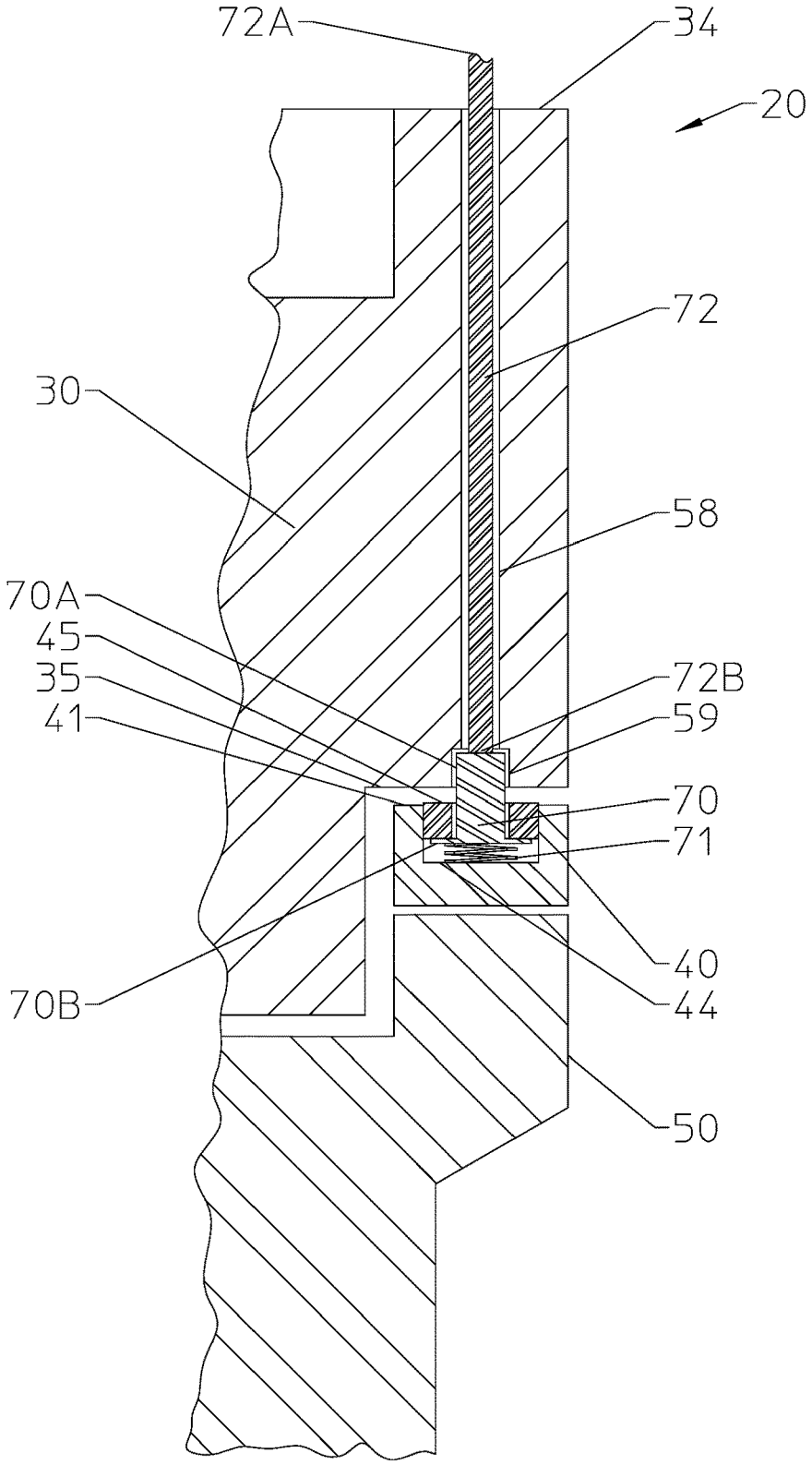
FIG. 4 is a partial cross-sectional view of the wellhead system having the tubing hanger system of FIG. 1A, in accordance with an embodiment of the present disclosure.

Referring now to FIG. 4, another safety mechanism according to one or more embodiments of the present disclosure is illustrated. A spring loaded pin disposed within the ramp ring 40 may be installed during assembly of the tubing hanger system 20 and engage the tubing hanger body 30 so as to rotationally lock the ramp ring to the tubing hanger body until the proper time in the tubing hanger system run-in in which the ramp ring must be rotationally actuated in order to take up any axial space created by the installation procedure.

The safety mechanism of the tubing hanger system 20 may include a safety lock pin 70, a safety lock spring 71, and a safety lock rod 72. The safety lock pin 70 and the safety lock spring 71 may be disposed within the ramp ring 40, and the safety lock rod 72 may be disposed within the tubing hanger body 30. The ramp ring 40, in one or more embodiments, may include a pin blind hole 44 disposed in an upper contact surface 41 and a pin securing mechanism 45. The safety lock spring 71 may be disposed within the pin blind hole 44 abutting a bottom of the blind hole, and the safety lock 70 pin may be disposed above the safety lock spring 71 in the blind hole such that the safety lock pin 70 is pushed up towards the tubing hanger body 30. The safety lock pin 70 may include a safety lock pin body 70*a* and a safety lock pin flange 70*b*, in which the diameter of the safety lock pin flange 70*b* is greater than the diameter of the safety lock pin body 70*a*. The pin securing mechanism 45 may be disposed in the opening of the pin blind hole 44 and may have an inner diameter larger than the safety lock pin body 70*a* but smaller than the diameter of the safety lock pin flange 70*b* such that the safety lock pin 70 is maintained within the pin blind hole 44 while the safety lock pin body 70*a* is able to extend past the upper contact surface 41 of the ramp ring 40.

Additionally, the tubing hanger body 30, in one or more embodiments, may include an elongated hole 58 that extends from an upward facing contact surface 34 to a downward facing contact surface 35. Further, a pin counterbore 59 may be sunk into the downward facing contact surface 35 and concentric with the hole 58. An inner diameter of the pin counterbore 59 may be slightly larger than the outer diameter of the safety lock pin body 70*a*, and the pin counterbore 59 may be configured to receive the safety lock pin 70 when the tubing hanger system 20 is assembled before run-in. Further, the safety lock rod 72 may be disposed within the hole 58. The safety lock rod 72 may be longer than the length of the hole 58 and the pin counterbore 59 such that when the safety lock pin 70 extends into the pin counterbore 59, the top end 72*a* of the safety lock rod 72 extends above the upward facing contact surface 34 and when the safety lock rod 72 is compressed down to the upward facing contact surface 34 into the hole 58, the bottom end 72*b* of the safety lock rod 72 is even with or extends slightly below the downward facing contact surface 35.

Further referring to FIG. 4, in one or more embodiments of the present disclosure, when the tubing hanger system 20 is assembled before run-in, the safety lock pin 70 may engage the pin counterbore 59. During the installation of the tubing hanger system 20 within a wellhead housing, installation of a locking mechanism may cause a locking mandrel to compress the safety lock rod 72 into the hole 58, which will cause the bottom end 72*b* of the safety lock rod 72 to push the safety lock pin 70 out of the pin counterbore 59. Once the safety lock pin 70 is removed from the pin counterbore 59, the tubing hanger body 30 and the ramp ring 40 will no longer be rotationally locked with respect to each other allowing the ramp ring 40 to rotate relative to the piston 50 along their respective ramp surfaces in order to remove any axial gaps in the tubing hanger system 20 created during the process of locking the tubing hanger system within the wellhead housing.

Figure 5A:
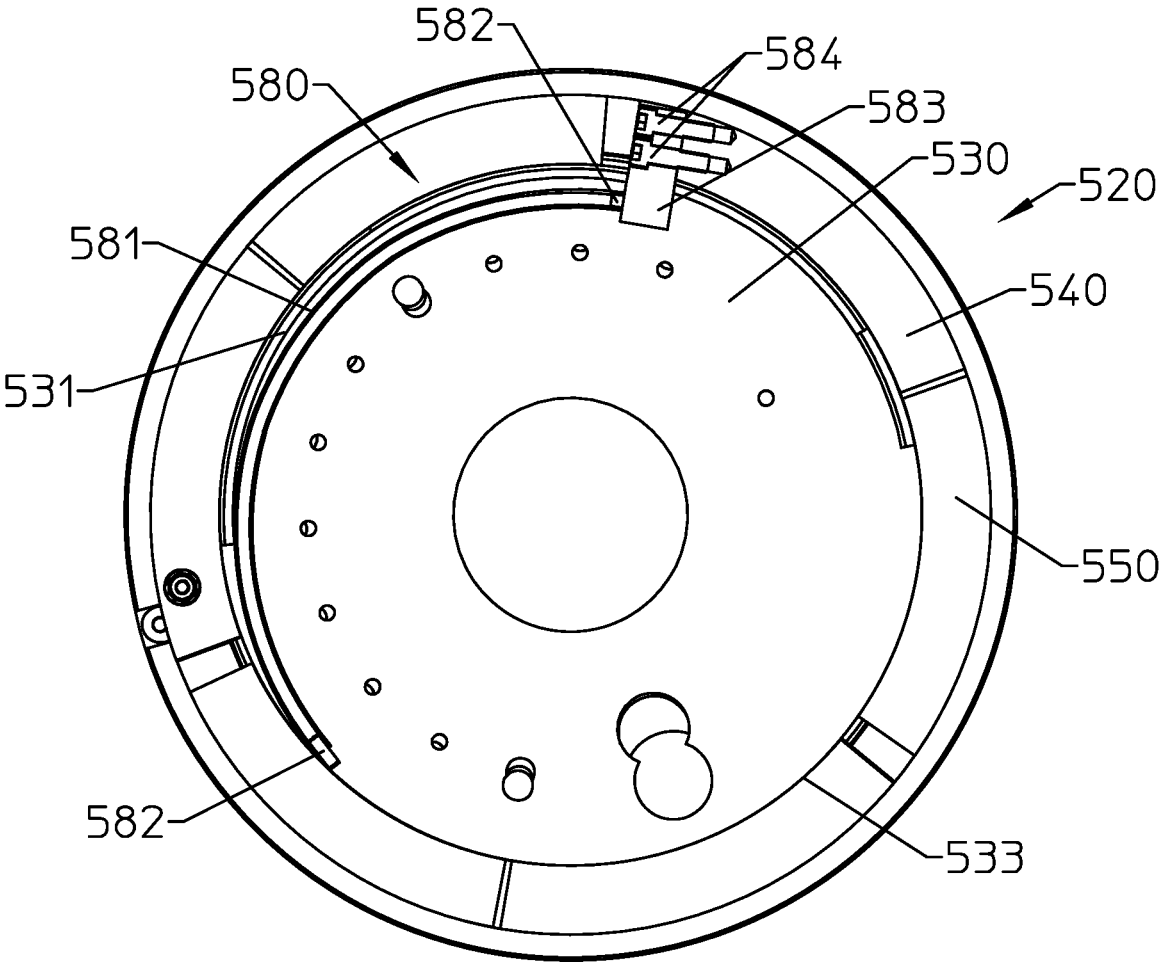
FIG. 5A is a top-down cross-sectional view of a tubing hanger system, in accordance with an embodiment of the present disclosure.
Figure 5B:
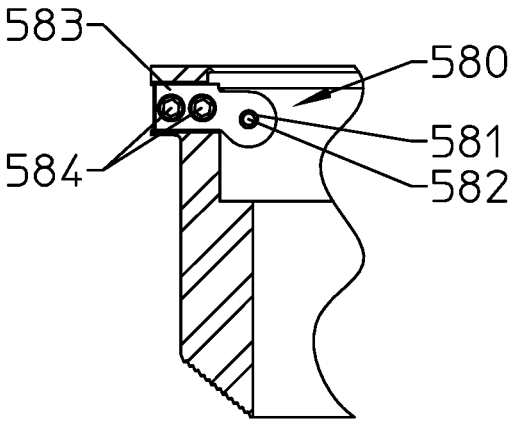
FIG. 5B is a partial perspective view of the tubing hanger system of FIG. 5A, in accordance with an embodiment of the present disclosure.

Referring now to FIGS. 5A and 5B, a tubing hanger system 520, according to one or more embodiments of the present disclosure, is illustrated. As discussed previously, the tubing hanger system 520 may include a tubing hanger body 530 and a space-out mechanism 500. Further, the space-out mechanism 500 may include a ramp ring 540 and a piston 550. Additionally, in one or more embodiments, the ramp ring 540 of the space-out mechanism 500 may be rotationally coupled to the tubing hanger body 530 by a circumferential spring mechanism 580. The circumferential spring mechanism 580 may be coupled to the ramp ring 540 on a first end and to the tubing hanger body 530 on a second end. The circumferential spring mechanism 580 may include a spring 581, spring connectors 582, a transfer block 583, and bolts 584. The spring 581 may be disposed within a circumferential groove 531 located on the second sealing profile 533 of the tubing hanger body 530. The circumferential groove 531 may be disposed between the downward facing contact surface (not shown) of the tubing hanger body 530 and the fourth seal groove (not shown), which is disposed on the second sealing profile 533 of the tubing hanger body 530. Further, the spring 581 may be directly coupled to the tubing hanger body 530 by a spring connector 582 on a first end of the circumferential groove 531 and may be directly coupled to the transfer block 583 by a spring connector 582 within a distal portion of the circumferential groove 531. The transfer block 583 may be directly coupled to the ramp ring 540 by bolts 584.

In one or more embodiments, when assembling the tubing hanger system 520 before run-in, the circumferential spring mechanism 580 may be preloaded such that when a safety mechanism rotationally locking the tubing hanger body 530 and the ramp ring 540 is disengaged, the space-out mechanism 500 self-actuates to rotate the ramp ring 540 against the piston 550 to extend the space-out mechanism 500 axially and remove any axial gaps that have formed during installation of the tubing hanger system 520 into wellhead housing. When the space-out mechanism 500 is actuated, the rotation of the ramp ring will cause the ramp surface of the ramp ring 540 to bear against and rotate against the ramp surface of the piston 530 and extend the space-out mechanism 500 axially.

By way of example, in one or more embodiments, the space-out mechanism 500 may be configured such that the preload puts the spring 581 in tension and releasing the safety mechanism causes the spring 581 to pull the ramp ring 540 causing it to rotate against the piston 550. However, one of ordinary skill would appreciate that in other embodiments, the spring 581 may be preloaded in compression such that releasing the safety mechanism causes the spring to push the ramp ring 540 causing it to rotate against the piston 550. Additionally, while a singe preloaded spring 581 is illustrated in FIGS. 5A and 5B, one of ordinary skill would appreciate that in other embodiments, there may be multiple springs situated in series or in parallel and preloaded in tension, compression, or torsion so as to rotate a ramp surface of the ramp ring 540 against a ramp surface of the piston 550 causing the space-out mechanism to extend axially and fill in any axial gaps created while rigidizing the tubing hanger system and casing hanger within the wellhead housing.

Figure 6A:
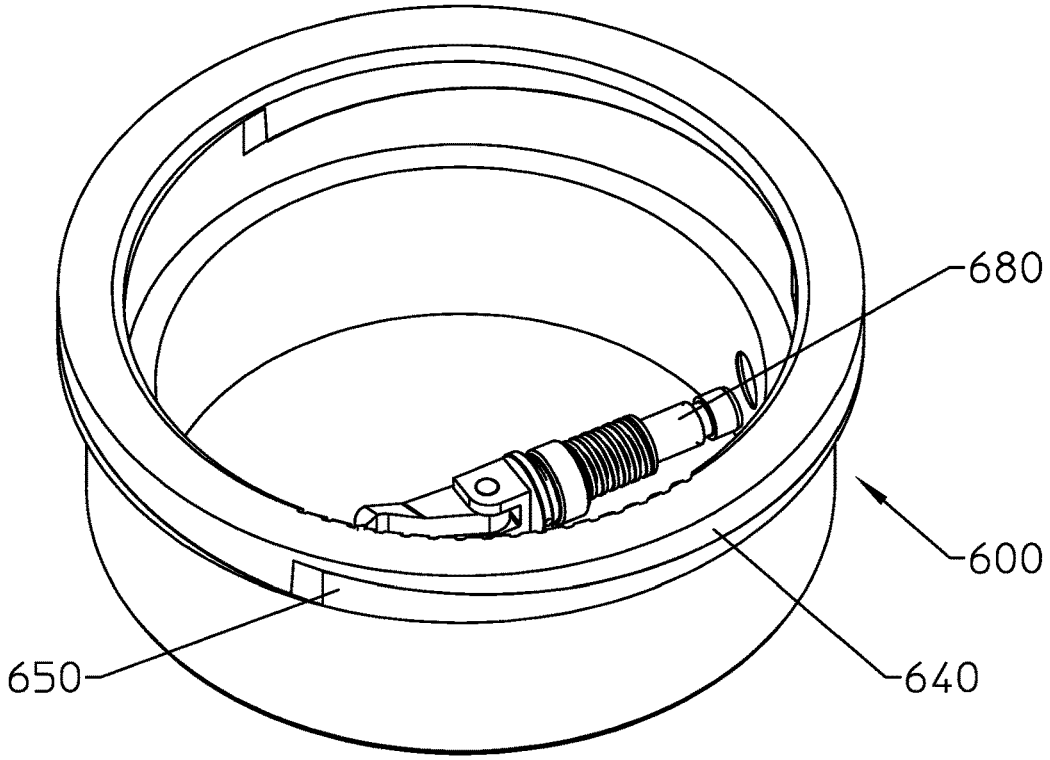
FIG. 6A is an isometric view of a tubing hanger system, in accordance with an embodiment of the present disclosure.
Figure 6B:
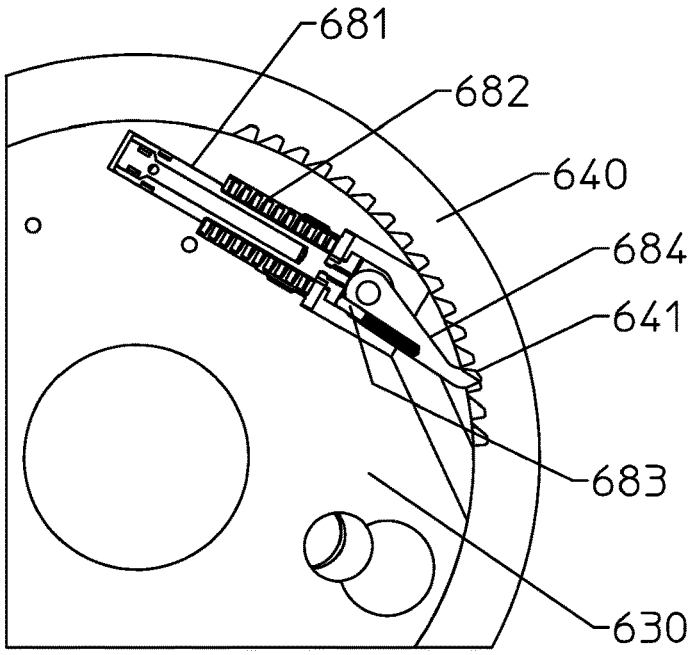
FIG. 6B is a partial top-down cross-sectional view of the tubing hanger system of FIG. 6A, in accordance with an embodiment of the present disclosure.

Referring now to FIGS. 6A and 6B, a tubing hanger system 620, according to one or more embodiments of the present disclosure, is illustrated. As discussed previously, the tubing hanger system 620 may include a tubing hanger body 630 and a space-out mechanism 600. Further, the space-out mechanism 600 may include a ramp ring 640 and a piston 650. Additionally, in one or more embodiments, the space-out mechanism may include a ratchet mechanism 680 disposed inside the tubing hanger system 620 that is configured to allow a user to remotely rotate the ramp ring 640 as necessary during run-in and the process of rigidizing the tubing hanger system 620 within the wellhead housing. The ramp ring 640 may include a plurality of inclined grooves 641 disposed circumferentially along its inner diameter. The ratchet mechanism 680 may be configured to engage the grooves 641 of the ramp ring 640 such that each stroke of the ratchet mechanism rotates the ramp ring 640 by the radial distance of a single groove. The ratchet mechanism 680, according to one or more embodiments of the present disclosure, may be a short stroke piston with a ratchet. The ratchet mechanism 680 may include a piston 681, a spring 682, an actuation arm 683, and a lever 684. The piston 681 and the spring 682 may be coaxially disposed with one end of the actuation arm 683 coupled to one end of the piston 681. Further, the other end of the actuation arm may be coupled to the lever 684, which is itself pinned to a non-moving portion of the piston 681, in order to force the lever 684 to rotate about the pinned connection. The piston 681 may be remotely controlled by a user so as to actuate the ratchet mechanism 680 by pulling the actuation arm 683 such that the lever 684 rotates out of the groove it is sitting in and then allowing the lever 684 to rotate back against the edge of a groove under the force of the spring 682, which causes the actuation arm to return the lever to its resting position, such that the lever 684 now engages an adjacent groove; thus, rotating the ramp ring 640, accordingly. Further, as discussed above, rotating the ramp ring 640 causes the ramp ring 640 to shift against the piston 650 to extend the space-out mechanism 600 axially and remove any axial gaps that have formed during installation of the tubing hanger system 620 into the wellhead housing. When the space-out mechanism 600 is actuated, the rotation of the ramp ring will cause the ramp surface of the ramp ring 640 to bear against and rotate against the ramp surface of the piston 630 and extend the space-out mechanism 600 axially.

Figure 7:
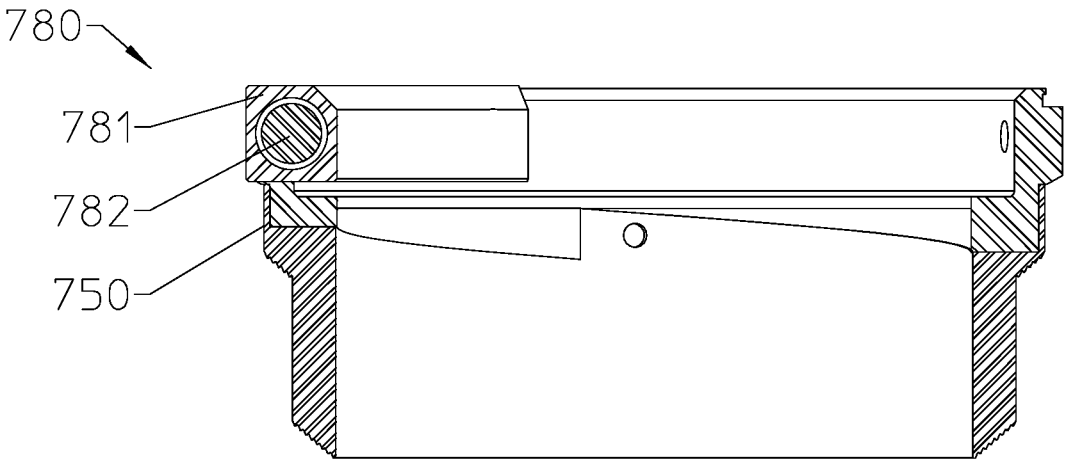
FIG. 7 is an isometric view of a ramp ring rotating mechanism, in accordance with an embodiment of the present disclosure.

Referring now to FIG. 7, a ramp ring rotating mechanism 780, according to one or more embodiments of the present disclosure, is illustrated. A space-out mechanism may include the ramp ring rotating mechanism 780 coupled to a ramp ring. The ramp ring rotating mechanism 780 may include a piston 781 and a curved piston rod 782. In one or more embodiments, the curved piston rod 782 may be 3-D printed. Further, the curved piston rod 782 may be disposed within the piston 781 and extend from the piston 781. An end of the curved piston rod 782 may be coupled to the ramp ring, and actuating the piston 781 may cause the curved piston rod 782 to extend, thus causing the ramp ring to rotate relative to a tubing hanger body and a piston 750 of a tubing hanger system. Further, as discussed above, rotating the ramp ring may cause the ramp ring to shift against the piston 750 to extend the space-out mechanism axially and remove any axial gaps that have formed during installation of the tubing hanger system into a wellhead housing. When the space-out mechanism is actuated, the rotation of the ramp ring may cause the ramp surface of the ramp ring to bear against and rotate against the ramp surface of the piston 750 and extend the space-out mechanism axially.

Figure 8A:
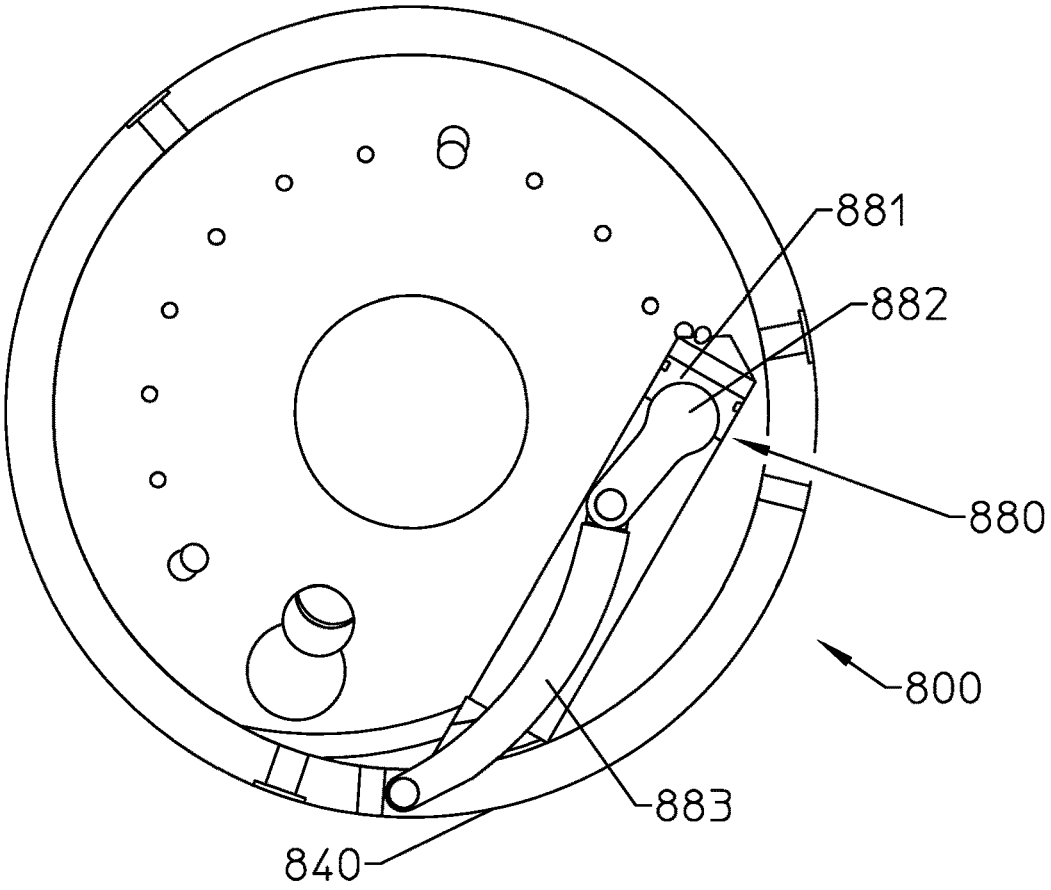
FIG. 8A is an isometric view of a ramp ring rotating mechanism, in accordance with an embodiment of the present disclosure.
Figure 8B:
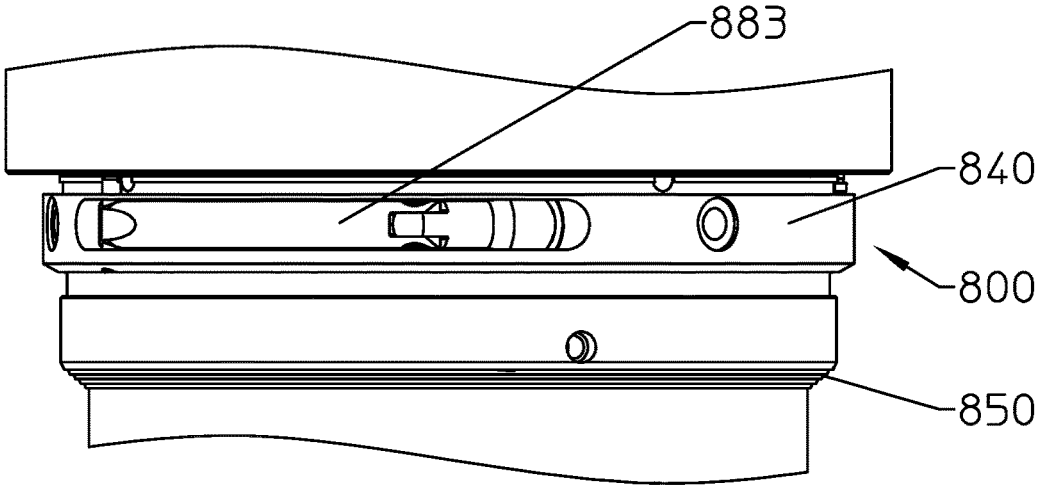
FIG. 8B is a partial perspective view of the ramp ring rotating mechanism of FIG. 8A, in accordance with an embodiment of the present disclosure.

Referring now to FIGS. 8A and 8B, a ramp ring rotating mechanism 880, according to one or more embodiments of the present disclosure, is illustrated. A space-out mechanism 800 may include the ramp ring rotating mechanism 880 coupled to a ramp ring 840. The ramp ring rotating mechanism 880 may include a piston 881, an arm 882, and a slider 883. In one or more embodiments, the arm 882 may be coupled to the piston 881 and may be rotated by way of actuation of the piston 881, which may be operated remotely by a user. An end of the arm 882 may be coupled to a first end of the slider 883, and a second end of the slider 883 may be coupled to the ramp ring 840. In one or more embodiments, the slider 883 may be coupled to the arm 882 and the ramp ring 840 by pins. Further, actuating the piston 881 may cause the arm 882 to rotate, thus causing the slider 883 to rotate about the pinned connection to the arm 882 and rotating the ramp ring 840 relative to a tubing hanger body and a piston 850 of a tubing hanger system. Further, as discussed above, rotating the ramp ring 840 may cause the ramp ring 840 to shift against the piston 850 to extend the space-out mechanism 800 axially and remove any axial gaps that have formed during installation of the tubing hanger system into a wellhead housing. When the space-out mechanism 800 is actuated, the rotation of the ramp ring 840 may cause the ramp surface of the ramp ring 840 to bear against and rotate against the ramp surface of the piston 850 and extend the space-out mechanism 800 axially.

Figure 9A:
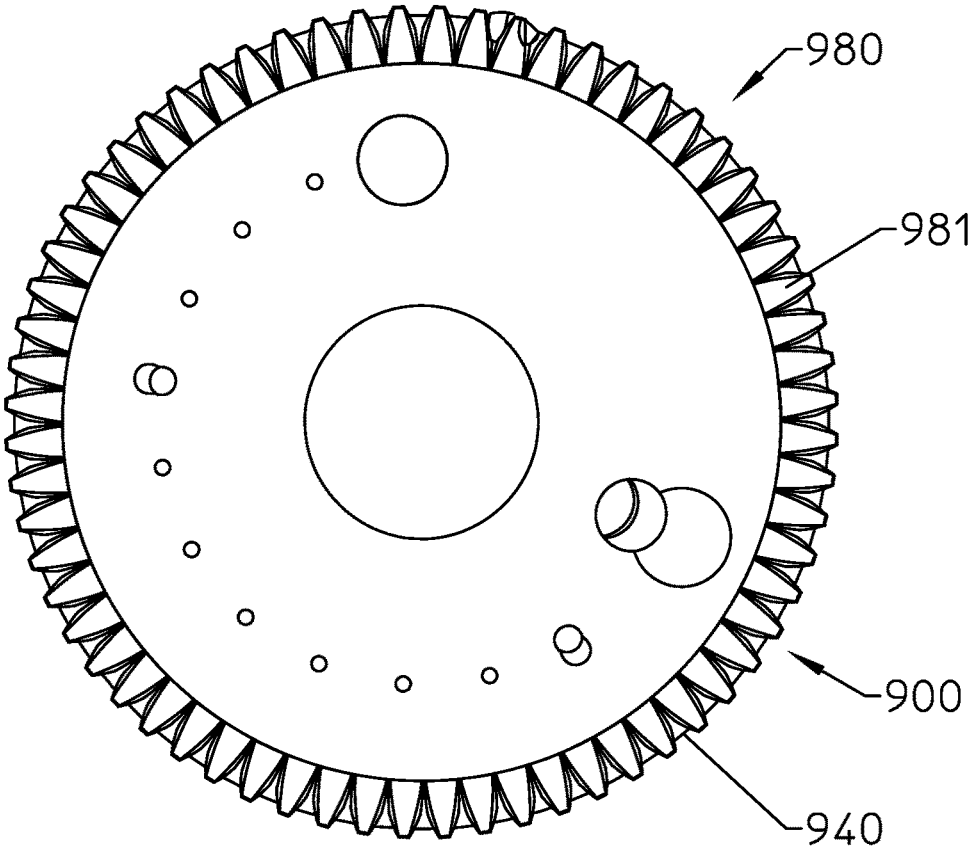
FIG. 9A is an isometric view of a ramp ring rotating mechanism, in accordance with an embodiment of the present disclosure.
Figure 9B:
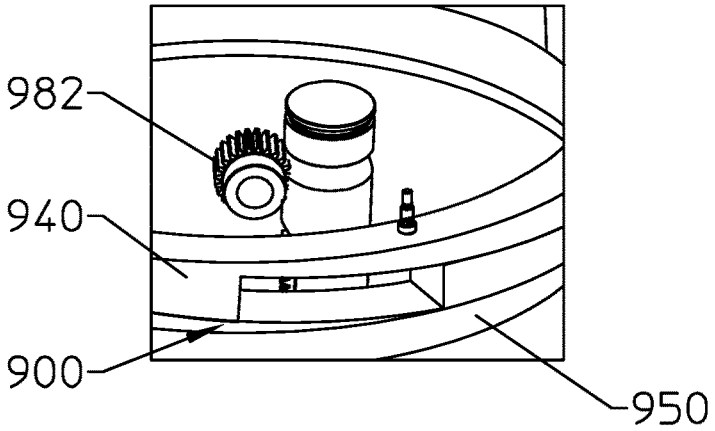
FIG. 9B is a partial perspective view of the ramp ring rotating mechanism of FIG. 9A, in accordance with an embodiment of the present disclosure.

Referring now to FIGS. 9A and 9B, a ramp ring rotating mechanism 980, according to one or more embodiments of the present disclosure, is illustrated. A space-out mechanism 900 may include the ramp ring rotating mechanism 980 coupled to a ramp ring 940. The ramp ring rotating mechanism 980 may be a geared mechanism and may include a curved rack 981 and a pinion 982. In one or more embodiments, the curved rack 981 may be coupled to a ramp ring 940 and the pinion 982. Further, rotation of the pinion 982 may cause rotation of the ramp ring 940 by way of the curved rack 981, and the pinion 982 may be rotated by remote operation by a user. Therefore, in one or more embodiments, rotation of the pinion 982 may cause the ramp ring 940 to rotate relative to a tubing hanger body and a piston 950 of a tubing hanger system. Further, as discussed above, rotating the ramp ring 940 may cause the ramp ring 940 to shift against the piston 950 to extend the space-out mechanism 900 axially and remove any axial gaps that have formed during installation of the tubing hanger system into a wellhead housing. When the space-out mechanism 900 is actuated, the rotation of the ramp ring 940 may cause the ramp surface of the ramp ring 940 to bear against and rotate against the ramp surface of the piston 950 and extend the space-out mechanism 900 axially.

Figure 10:
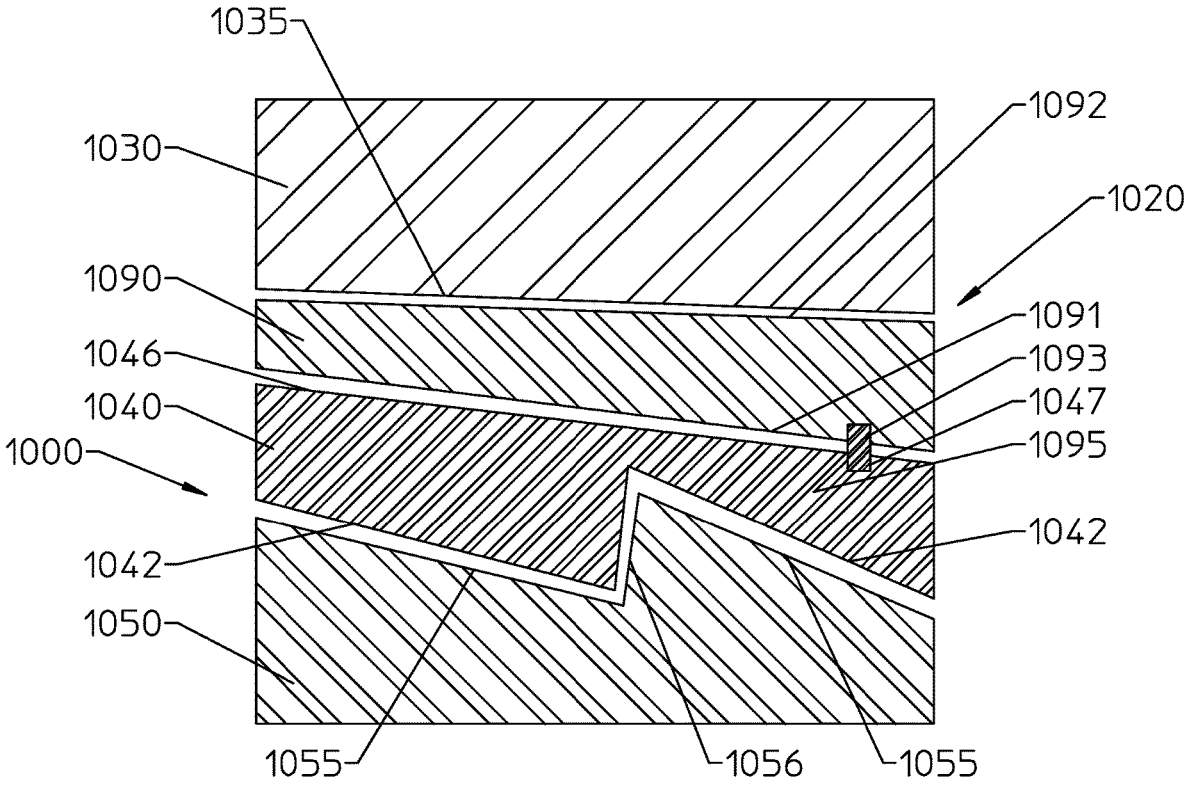
FIG. 10 is a partial cutaway view of a tubing hanger system, in accordance with an embodiment of the present disclosure.

Referring now to FIG. 10, a partial cutaway view of a tubing hanger system 1020, according to one or more embodiments of the present disclosure, is illustrated. The tubing hanger system 1020 may include a tubing hanger body 1030 and a space-out mechanism 1000. The space-out mechanism 1000 may include a first ramp ring 1040, a second ramp ring 1090, and a piston 1050. The piston 1050 may include ramp surfaces 1055 and rotational stop surfaces 1056.

Further, the first ramp ring 1040 may include lower ramp surfaces 1042 and an upper ramp surface 1046. The lower ramp surfaces 1042 may contact the ramp surfaces 1055 of the piston 1050, and in one or more embodiments, the ramp surfaces 1042 of the ramp ring 1040 and the ramp surfaces 1055 of the piston 1050 may match in number and taper. By way of example, in one or more embodiments, the ramp ring 1040 may include multiple ramp surfaces 1042 each extending 120° circumferentially about the ramp ring 1040. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 1042, 1055 may all have a constant 4° taper. However, one of ordinary skill in the art will understand that in other embodiments the ramp surface may include steps or ridges and/or may have a constant or changing taper in the range of 0.5°-7°. Additionally, the upper ramp surface 1046 of the first ramp ring 1040 may have a constant taper. In one or more embodiments, the upper ramp surface 1046 may have a constant taper of 0.5°. However, one of ordinary skill in the art will understand that in other embodiments the ramp surface may include steps or ridges and/or may have a constant or changing taper in the range of 0.5°-7°. Further, a pin blind hole 1047 may be formed on the upper ramp surface 1046.

Furthermore, the second ramp ring 1090 may include a lower ramp surface 1091 and an upper contact surface 1092. The lower ramp surface 1091 of the second ramp ring 1090 may contact and may match the taper of the upper ramp surface 1046 of the first ramp ring 1040. As discussed above, the lower ramp surface 1091 may have a constant taper of 0.5°. However, one of ordinary skill in the art will understand that in other embodiments the lower ramp surface 1091 may include steps or ridges and/or may have a constant or changing taper in the range of 0.5°-7° that matches that of the upper ramp surface 1046 of the first ramp ring 1040. Further, a pin blind hole 1093 may be formed on the lower ramp surface 1091 and may be coaxially aligned with the pin blind hole 1047 of the first ramp ring 1040 during assembly. Further, a shear pin 1095 may be disposed within the aligned pin blind holes 1047, 1093 to rotationally lock the first ramp ring 1040 and the second ramp ring 1090 until a sufficient piston force is applied to either the first ramp ring 1040 or the second ramp ring 1090 to shear the shear pin 1095 when locking and rigidizing the tubing hanger system 1020 within a wellhead housing.

Additionally, the tubing hanger body 1030 may include a downward facing contact surface 1035. The downward facing contact surface 1035 of the tubing hanger body 1030 may contact upper contact surface 1092 of the second ramp ring 1090 at least when the tubing hanger system 1020 is run-in and when the tubing hanger system 1020 is in a fully locked and rigidized position within the wellhead housing.

Figure 11:
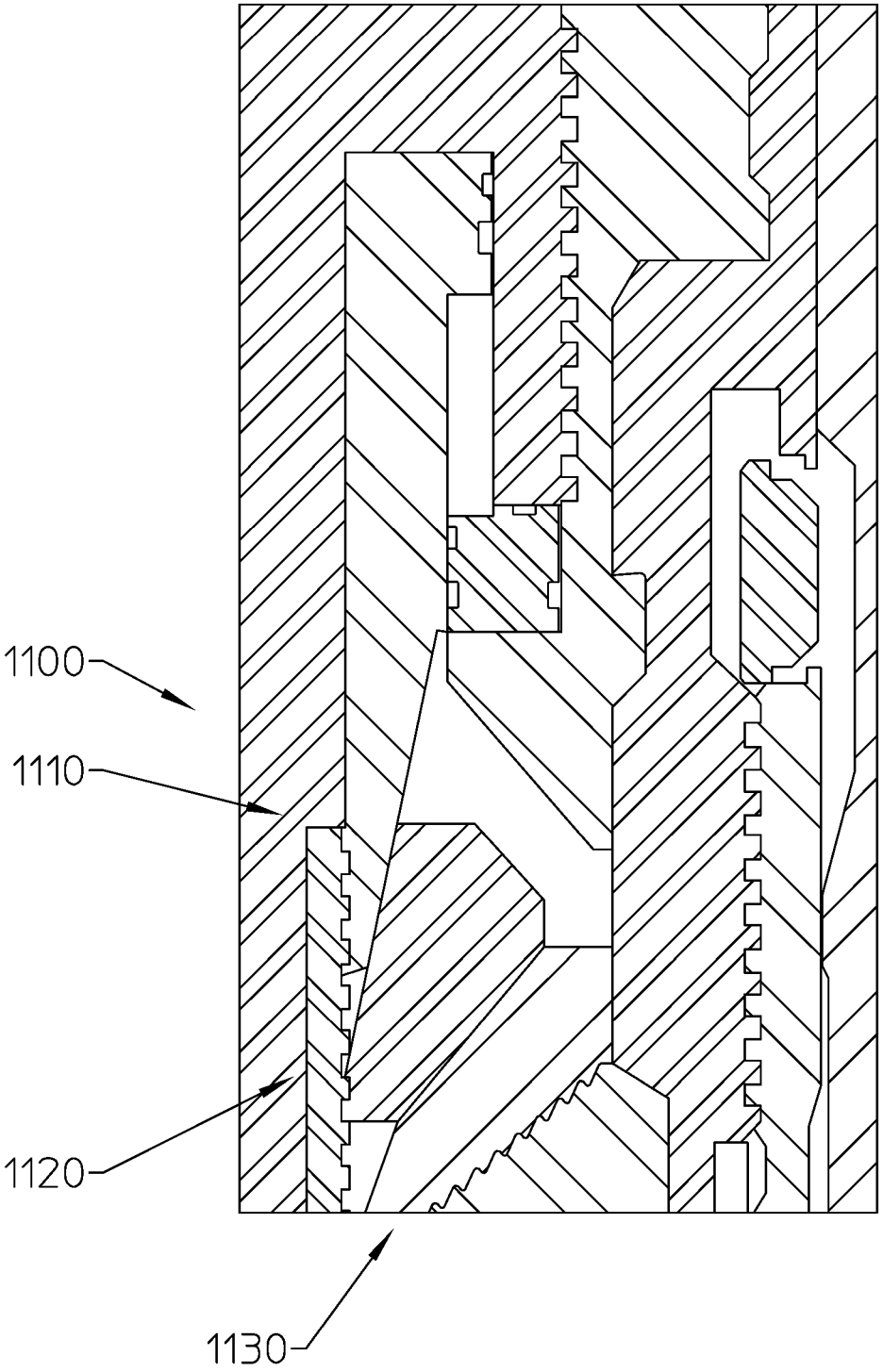
FIG. 11 is a partial cross-sectional view of a tubing hanger locking system, in accordance with an embodiment of the present disclosure.

Referring now to FIG. 11, a tubing hanger locking system 1100, according to one or more embodiments of the present disclosure, is illustrated. The tubing hanger locking system 1100 may include, at least, a piston 1110, locking dogs 1120, and a wedge 1130. The piston 1110, the locking dogs 1120, and the wedge 1130 may be configured and coupled such that the tubing hanger locking system 1100 locks a tubing hanger in place within a wellhead housing and rigidizes a tubing hanger and casing hanger within the wellhead housing.

While one or more embodiments of the present disclosure may include a piston 50, 550, 650, 750, 850, 950, 1050, one of ordinary skill would appreciate that in other embodiments, a space-out mechanism of a tubing hanger system may instead include a lower member, which may be a non-actuating member. However, as discussed above with respect to pistons of one or more embodiments of the present disclosure, the lower member may include, at least, ramp surfaces and rotational stop surfaces and may be configured to interact with a ramp ring in order to lock a casing hanger and a tubing hanger system in place within a wellhead housing and rigidize the system.

It should be understood that the present disclosure contemplates a method to lock and rigidize a tubing hanger system and casing hanger within a wellhead housing. The present disclosure also contemplates a method to assemble a tubing hanger system.

In one or more embodiments of the present disclosure, assembly of the tubing hanger system may include disposing a space-out mechanism about a first sealing profile and second sealing profile of a tubing hanger body. Further, in one or more embodiments where the space-out mechanism includes a ramp ring and a piston, a ramp ring may be disposed about the second sealing profile of the tubing hanger body. Then, in one or more embodiments including a safety mechanism for locking a rotation of the ramp ring relative to the tubing hanger body, the portions of the safety mechanism in the ramp ring and in the tubing hanger body may be aligned and coupled. This may further include disposing a safety lock spring in a pin blind hole, disposing a safety lock pin on top of the safety lock spring in the pin blind hole, and disposing a pin securing mechanism into the opening of the pin blind hole. Further, once the safety mechanism for locking a rotation of the ramp ring relative to the tubing hanger body is properly aligned and the safety lock pin is inserted into the pin counterbore of the tubing hanger body, a safety lock rod may be disposed within an elongated hole in the tubing hanger body. Further, if a space-out mechanism requires a pre-load to be applied to a mechanism configured to rotate the ramp ring relative to the tubing hanger body, the pre-load will be applied before rotationally locking the ramp ring and the tubing hanger body by way of the safety mechanism.

Then, in one or more embodiments, a piston may be disposed about the first sealing profile and the second sealing profile of the tubing hanger body. Once the piston is properly installed such that the seals of the tubing hanger body are properly located within the piston, the piston and the tubing hanger body may be aligned such that the anti-rotation pin may be threaded into the threaded pin borehole of the piston and extend into a pin slot of the tubing hanger body. Additionally, in one or more embodiments, a retainer ring may be disposed within a third groove of the tubing hanger body.

Additionally, in one or more embodiments of the present disclosure, locking and rigidizing a tubing hanger system and casing hanger within a wellhead housing may include running an assembled tubing hanger system into the wellhead housing, landing the tubing hanger system on the casing hanger and sealing a tubing hanger to casing hanger seal of the tubing hanger body against the casing hanger. Landing the tubing hanger system on the casing hanger may further include collapsing a retaining ring into a third groove of the tubing hanger body. Then, in one or more embodiments, a seal test on the tubing hanger to casing hanger seal may be performed. Once the seal test confirms that the seals are properly set, the tubing hanger may be locked. The process of locking the tubing hanger may activate the safety lock rod and engage the locking dogs into their locking profile within the wellhead housing. Then, the tubing hanger body may be lifted to preload the locking mechanism in place within the wellhead housing.

In one or more embodiments, the space-out mechanism may then be actuated, taking up any axial gaps created by lifting on the tubing hanger body and rigidizing the tubing hanger system within the wellhead housing. Actuating the space-out mechanism may further include unlocking a safety mechanism. Unlocking the safety mechanism may include compressing a safety locking rod into an elongated hole of the tubing hanger body and pushing a safety lock pin out of a pin counterbore of the tubing hanger body such that the ramp ring is no longer rotationally locked to the tubing hanger body. Actuating the space-out mechanism may further include moving the piston down to push against the casing hanger, rotating the ramp ring, and filling the gap between the piston and the tubing hanger body. Once the space-out mechanism has been activated to rigidize the tubing hanger body and the casing body within the wellhead housing, the casing hanger seal may be seal tested to ensure that it is still properly sealing. Then, finally, the tubing hanger system may be released.

Although the present disclosure and its advantages have been described in detail, it should be understood that various changes, substitutions and alterations can be made herein without departing from the spirit and scope of the disclosure as defined by the following claims.

What is claimed is:

1. A system, comprising:
a tubing hanger body; and
a space-out mechanism, the space-out mechanism comprising:
a ramp ring having a tapered surface; and
a lower member rotationally locked to the tubing hanger body, the lower member having a tapered surface,
wherein the ramp ring is configured to rotate relative to the tubing hanger body and the lower member, and
wherein the tapered surface of the ramp ring and the tapered surface of the lower member are configured to bear against each other to rigidize the system.

2. The system of claim 1, wherein the tapered surfaces of the ramp ring and the lower member are complimentary.

3. The system of claim 2, wherein the taper of the tapered surface of the ramp ring and the taper of the tapered surface of the lower member have a slope between 0.5° and 7°.

4. The system of claim 1, wherein:
the ramp ring further comprises:
a ramp ring rotational stop surface;
the lower member further comprises:
a lower member rotational stop surface; and
the ramp ring rotational stop surface is configured to abut the lower member rotation stop surface.

5. The system of claim 1, further comprising:
an anti-rotation pin, wherein:
the tubing hanger body further comprises:
a radially exterior profile having a pin slot;
the lower member further comprises:
a threaded pin borehole;
the anti-rotation pin is coupled to the threaded pin borehole and disposed within the pin slot; and
the anti-rotation pin is configured to rotationally lock the lower member to the tubing hanger body.

6. The system of claim 1, wherein:
the tubing hanger body comprises:
a downward facing contact surface; and
a radially exterior profile having a first sealing profile and a second sealing profile;
the lower member further comprises:
a first interior seal surface; and
a second interior seal surface;
the ramp ring further comprises:
an upper contact surface;
the upper contact surface of the ramp ring is configured to abut the downward facing contact surface of the tubing hanger body;
a first seal is formed between the first interior seal surface of the lower member and the first sealing profile of the tubing hanger body; and
a second seal is formed between the second interior seal surface of the lower member and the second sealing profile of the tubing hanger body.

7. The system of claim 6, wherein the lower member further comprises:
an interior shoulder disposed between the first interior seal surface and the second interior seal surface, wherein the interior shoulder, the first seal, and the second seal are configured to create a piston force axially downward on the lower member.

8. The system of claim 1, further comprising:
a casing hanger; and
a locking mechanism, wherein the locking mechanism is configured to lock the casing hanger, the tubing hanger body, the space-out mechanism, and the locking mechanism in place within a wellhead housing.

9. The system of claim 8, wherein:
the casing hanger comprises:
an upper load shoulder; and
a radially interior profile;
the tubing hanger body comprises:
an upward facing contact surface;
a downward facing contact surface; and
a radially exterior profile having a first sealing profile and a second sealing profile;
the lower member further comprises:
a lower load shoulder;
a first interior seal surface; and
a second interior seal surface;
the ramp ring further comprises:
an upper contact surface;

the lower load shoulder of the lower member is configured to abut the upper load shoulder of the casing hanger;

the upper contact surface of the ramp ring is configured to abut the downward facing contact surface of the tubing hanger body;

the locking mechanism abuts the upward facing contact surface of the tubing hanger body;

a first seal is formed between the first interior seal surface of the lower member and the first sealing profile of the tubing hanger body;

a second seal is formed between the second interior seal surface of the lower member and the second sealing profile of the tubing hanger body; and a third seal is formed between the first sealing profile of the tubing hanger body and the interior profile of the casing hanger.

10. The system of claim 9, wherein the lower member further comprises:

an interior shoulder disposed between the first interior seal surface and the second interior seal surface, wherein the interior shoulder, the first seal, and the second seal are configured to create a piston force axially downward on the lower member within the wellhead housing.

11. The system of claim 1, further comprising:

a safety mechanism disposed within and between the ramp ring and the tubing hanger body, wherein when the safety mechanism is in a locked position, the ramp ring cannot rotate relative to the tubing hanger body, and when the safety mechanism is in an unlocked position, the ramp ring can rotate relative to the tubing hanger body.

12. The system of claim 1, further comprising:

a retainer ring disposed within a groove in a radially exterior profile of the tubing hanger body, wherein the retainer ring is configured to collapse into the groove in the radially exterior profile of the tubing hanger body.

13. A method, comprising:

assembling a tubing hanger system, the tubing hanger system including a tubing hanger body and a space-out mechanism;

running the tubing hanger system into a wellhead housing until the tubing hanger system lands on a casing hanger;

locking the tubing hanger system to the wellhead housing;

lifting the tubing hanger system; and actuating the space-out mechanism to rigidize the tubing hanger system within the wellhead housing, wherein the space-out mechanism comprises:

a ramp ring having a tapered surface; and a lower member having a tapered surface, wherein the ramp ring tapered surface and the lower member tapered surface are configured to bear against each other; and wherein assembling the tubing hanger system comprises:

rotationally locking the lower member to the tubing hanger body.

14. The method of claim 13, wherein:

the tubing hanger body comprises:

a radially exterior profile having a first sealing profile and a second sealing profile; and assembling the tubing hanger system further comprises:

disposing the ramp ring about the second sealing profile of the tubing hanger body; and disposing the lower member about the first sealing profile and the second sealing profile of the tubing hanger body.

15. The method of claim 14, wherein:

the lower member comprises:

a threaded pin borehole;

the radially exterior profile of the tubing hanger body further comprises:

a pin slot;

rotationally locking the lower member to the tubing hanger body comprises:

aligning the threaded pin borehole of the lower member with the pin slot of the tubing hanger body; and threading an anti-rotation pin into the threaded pin borehole of the lower member, wherein the anti-rotation pin is configured to extend into the pin slot of the tubing hanger body when threaded into the threaded pin borehole.

16. The method of claim 14, wherein the tapered surfaces of the ramp ring and the lower member are complementary.

17. The method of claim 14, further comprising:

installing a safety mechanism into the tubing hanger system, wherein when the safety mechanism is in a locked position, the ramp ring cannot rotate relative to the tubing hanger body, and when the safety mechanism is in an unlocked position, the ramp ring can rotate relative to the tubing hanger body.

18. The method of claim 13, wherein:

the tubing hanger body comprises:

a radially exterior profile having a first sealing profile and a second sealing profile, wherein the first sealing profile includes a first seal groove, a second seal groove, and a third seal groove, and wherein the second sealing profile includes a fourth seal groove; and assembling the tubing hanger system comprises:

installing a first seal in the first seal groove;

installing an o-ring in the second seal groove;

installing a second seal in the third seal groove; and installing a third seal in the fourth groove.

19. The method of claim 18, wherein:

the first sealing profile of the radially exterior profile of the tubing hanger body further comprises:

a fifth groove;

assembling the tubing hanger system further comprises:

installing a retainer ring within the fifth groove; and running the tubing hanger system into a wellhead housing until the tubing hanger system lands on a casing hanger comprises:

collapsing the retainer ring into the fifth groove.

20. The method of claim 18, further comprising:

forming a seal between a casing hanger body of the casing hanger and the tubing hanger body using the first seal; and performing a seal test on the seal formed between the casing hanger body and the tubing hanger body using the first seal.

* * * * *